US012312785B2

(12) United States Patent
Funke et al.

(10) Patent No.: US 12,312,785 B2
(45) Date of Patent: May 27, 2025

(54) SANITARY SYSTEM FOR DISPENSING TREATED LIQUIDS

(71) Applicant: BLANCO GMBH + CO KG, Oberderdingen (DE)

(72) Inventors: Thomas Funke, Eppingen (DE); Olaf Stenvers, Mannheim (DE); Stefan Keller, Zaberfeld (DE)

(73) Assignee: BLANCO GMBH + CO KG, Oberderdingen (DE)

( * ) Notice: Subject to any disclaimer, the term of this patent is extended or adjusted under 35 U.S.C. 154(b) by 238 days.

(21) Appl. No.: 17/979,411

(22) Filed: Nov. 2, 2022

(65) Prior Publication Data

US 2023/0139384 A1 May 4, 2023

(30) Foreign Application Priority Data

Nov. 4, 2021 (DE) ..... 10 2021 212 428.3

(51) Int. Cl.
*E03C 1/04* (2006.01)
*E03C 1/044* (2006.01)
*E03C 1/046* (2006.01)

(52) U.S. Cl.
CPC ..... *E03C 1/0412* (2013.01); *E03C 1/044* (2013.01); *E03C 1/046* (2013.01); *E03C 1/0411* (2013.01); *E03C 2001/0418* (2013.01); *E03C 2201/40* (2013.01); *E03C 2201/45* (2013.01)

(58) Field of Classification Search
CPC ..... E03C 1/0412; E03C 1/044; E03C 1/046; E03C 1/0411; E03C 2001/0418; E03C 2201/40; E03C 2201/45; E03C 1/055; E03C 1/0404; E03C 1/057; B67D 1/0857; B67D 1/0895; B67D 1/0021; B67D 1/0059
See application file for complete search history.

(56) References Cited

U.S. PATENT DOCUMENTS 5,417,348 A * 5/1995 Perrin ..... B67D 1/0059 4/675
9,739,040 B2 8/2017 Gnauert et al.
(Continued)

FOREIGN PATENT DOCUMENTS

DE 10 2013 000 773 7/2014
DE 10 2013 002 236 8/2014
(Continued)

*Primary Examiner* — Donnell A Long
(74) *Attorney, Agent, or Firm* — WENDEROTH, LIND & PONACK, L.L.P.

(57) ABSTRACT

A sanitary system includes a sanitary faucet, and a control device. The sanitary faucet includes: (i) a first control element for setting at least one of a plurality of quantities of a liquid to be dispensed; and (ii) a second control element for setting at least one of a plurality of types of the liquid to be dispensed. At least one of the first control element or the second control element has a plurality of defined control positions. The control device is connected to the first control element and the second control element. The control device is programmed to assign at least one of the plurality of defined control positions so as to preconfigure or reconfigure: (i) the at least one of the plurality of quantities of the liquid to be dispensed; or (ii) the at least one of the plurality of types of the liquid to be dispensed.

15 Claims, 3 Drawing Sheets

(56) References Cited

U.S. PATENT DOCUMENTS

| | | | | |
|---|---|---|---|---|
| 11,618,666 | B2 * | 4/2023 | Cahill | B67D 1/1405 251/30.01 |
| 2007/0152074 | A1 | 7/2007 | Stowe et al. | |
| 2009/0077736 | A1 * | 3/2009 | Loberger | E03C 1/057 4/619 |
| 2009/0277508 | A1 * | 11/2009 | Pohl | G05D 23/1393 137/88 |
| 2010/0148971 | A1 * | 6/2010 | Wawrla | E03C 1/057 340/573.1 |
| 2011/0320134 | A1 * | 12/2011 | Butler | C02F 1/008 702/25 |
| 2012/0017367 | A1 * | 1/2012 | Reeder | E03C 1/057 4/597 |
| 2012/0266973 | A1 * | 10/2012 | Gray | E03C 1/055 137/334 |
| 2017/0254055 | A1 | 9/2017 | Xia | |
| 2019/0270630 | A1 | 9/2019 | Dahan et al. | |
| 2020/0123744 | A1 | 4/2020 | Keel et al. | |
| 2021/0017010 | A1 | 1/2021 | Funke et al. | |

FOREIGN PATENT DOCUMENTS

| | | |
|---|---|---|
| DE | 10 2018 126 214 | 4/2020 |
| DE | 10 2019 210 435 | 1/2021 |
| EP | 3 533 937 | 9/2019 |
| EP | 3 766 828 | 1/2021 |
| WO | 2016/040986 | 3/2016 |

* cited by examiner

SANITARY SYSTEM FOR DISPENSING TREATED LIQUIDS

BACKGROUND OF THE INVENTION

1. Field of the Invention

The invention relates to a sanitary fitting for dispensing treated liquids, comprising a first control element for setting a quantity of a liquid to be dispensed and a second control element for setting the type of liquid to be dispensed, wherein at least one of the two control elements has several defined control positions.

The invention further relates to a sanitary system comprising a sanitary fitting and a treatment device connected to the sanitary fitting for providing treated liquid.

2. Description of the Related Art

Sanitary fittings have become known in a variety of ways. Known sanitary fittings have, for instance, a fitting body having at least one control element for setting at least one characteristic of a fluid flow routed through the sanitary fitting. The property may be, for instance, the flow rate of the fluid flow or the temperature of the fluid flow. In known sanitary fittings, for instance, the fluid flow is mixed from a separate cold-water flow and hot-water flow by means of a mixing device, and from there it is routed to an outlet.

To increase functionality, for instance, a sanitary fitting has become known from DE 10 2013 000 773 A1 or DE 10 2013 002 236 A1 having at least one first control element for setting the temperature and/or quantity of mixed water and having at least one second control element for setting the quantity of hot water. The second control element, which can be used to adjust the amount of hot water, is designed as a rotary selector switch. It must first be turned in a first direction to activate the hot water function. Then, this must be turned in the direction opposite to the first direction to set the desired amount of hot water.

From DE 10 2019 210 435 A1, a sanitary fitting for dispensing treated liquids, in particular for beverages, is known, comprising a first control element for setting the quantity of the treated liquid to be dispensed and an control element for providing the quantity of treated liquid set by means of the first control element, wherein at least one second control element is arranged for selecting a type of treatment, in particular of at least two different types of treatment, from untreated liquid, wherein the first and the at least one second control element can be actuated independently of each other. The two control elements have defined control positions, wherein every control position is permanently assigned to the type and quantity of the treated liquid.

Only a very limited number of possible types and quantities of processed liquids can be selected. This is particularly disadvantageous due to the different customer requirements and specifications worldwide, for instance with regard to different quantities to be dispensed. In addition, this also makes the manufacture of the sanitary fitting more expensive, as it has to be adapted separately to different countries.

SUMMARY OF THE INVENTION

This invention therefore addresses the problem of providing a sanitary fitting and a sanitary system, which offer an increased flexibility in terms of adaptability to different quantities and types of liquid treated, while being simple to manufacture and offering a superior user experience.

In an embodiment, this invention solves the problems mentioned above based on a sanitary fitting for dispensing treated liquids, comprising

- a first control element for setting a quantity of a liquid to be dispensed,
- a second control element for setting the type of liquid to be dispensed,
- wherein at least one of the two control elements has several defined control positions, and
- a control device, which is connected to the control elements and which can be configured in such a way that the control device can be used to assign at least one defined actuator position to a configurable quantity of a type of liquid to be dispensed and/or a configurable type of liquid to be dispensed.

In an embodiment, this invention solves the problems above based on a sanitary system comprising a sanitary fitting, and a treatment device connected to the sanitary fitting for providing treated liquid, in particular wherein the treatment device comprises at least one of the devices listed below:

- a filter device for providing a filtered fluid, in particular filtered water,
- a carbonation device for providing a carbonated fluid, in particular carbonated water,
- a warming and/or heating device for providing fluids at high temperature, in particular hot water,
- a cooling device, in particular for providing a cooled fluid, in particular water,
- an ionization device for ionizing a fluid, in particular water,
- an enrichment device for enriching the fluid by adding at least one substance, in particular mineral substance, flavoring, coloring or the like,
- an add-on device for adding concentrates, in particular fruit juice concentrates or the like, to a fluid,
- a hygienic device for providing hygienically treated fluid, in particular for sterilizing a fluid, and/or
- a cleaning device for providing a cleaning and/or rinsing medium instead of or to be added to a fluid.

One of the advantages achieved in this way is that it significantly increases flexibility for both a user and a manufacturer of the sanitary fixture. A user can then optimally set any desired quantity specifications or, for instance, adapt the settings to any existing drinking vessels. The advantage for the manufacturer is that, depending on the country in which the sanitary fitting is to be used, it can initially preconfigure the sanitary fitting with regard to the quantities to be dispensed without having to make any structural changes to the sanitary fitting as a whole. Another advantage is the superior user experience, as the user can decide for himself and program the positions of the control elements based on functions such as type of liquid or quantity. In this way, operability is also improved.

The term "treated liquid" shall be understood in the broadest sense and refers, in particular in the claims, preferably in the description, to liquids, in particular water in the form of tap water from a water supplier or the like, the properties and/or composition of which is additionally changed by a separate device. For instance, treated water may have a high temperature, so-called hot water, a different degree of carbonation, a partially different composition or the like for the water originally provided by the water supplier. The term "treated liquid" shall in particular not be understood to denote hot or cold water, which is usually provided by a water supplier to a single-family house, multiple-family house or the like, and the temperature of which may be adjusted via a heating system or the like.

The term "type of treatment" shall be understood in the broadest sense and refers, in particular in the claims, preferably in the description, not only to the basic type of treatment of a liquid, for instance whether the water has been carbonated or not, but also to the degree, intensity or concentration of the treatment, for instance the intensity of carbonation. Different types of treatment shall thus be understood to denote, for instance, different degrees of carbonation, such as "still", "medium" or "classic". Different types of treatment also comprise different temperatures of hot water, water filtered to different degrees, different concentrations of flavor additives or flavorings, different types of mineralization, and different concentrations of the same type of mineralization or the like. The term "type of treatment" also includes, in particular, "non-treatment".

Further features, advantages and further embodiments of the invention are described below or may be disclosed in that way.

According to a preferred embodiment of the invention, at least one of the control elements and/or the control device has/have a wired and/or a wireless interface for configuring at least one of the control positions. In this way, a user can configure the actuator positions based on functions in a simple and direct manner, for instance using a Bluetooth connection of a smartphone and a corresponding App.

According to a further preferred embodiment of the invention, a display device is arranged for the visual and/or audible display of the configuration. The advantage thereof is that it further improves the user experience with regard to the representation and/or feedback of different states, error messages and the like.

According to a further preferred embodiment of the invention, the display device can be used to provide an optical sequence in the form of flashing and/or intermittent display of colors for configuring the control device and at least one defined actuator position. One of the advantages achieved in this way is, for instance, the actuator positions that can be configured in a way that is unambiguous for a user.

According to a further preferred embodiment of the invention, the control device is designed to store different configurations for different users of the sanitary fitting. This further enhances the user experience, as different users of the sanitary fitting can store different profiles, i.e., they can always operate the sanitary fitting in the usual way.

According to a further preferred embodiment of the invention, the control device comprises an interface for the selection of a desired configuration by a user. The advantage thereof is that the user can easily and quickly access and use his/her profile. For this purpose, for instance, a sensor switch that can be operated by tapping or a mechanical switch can be provided.

According to a further preferred embodiment of the invention, the configuration of at least one of the control positions is cloud-based, wherein the control device has an interface to connect to the Internet. One of the advantages thus achieved is improved user-friendliness and, at the same time, a simple central configuration option for the sanitary fitting by one manufacturer.

According to a further preferred embodiment of the invention, the display device is integrated in at least one of the control elements. This means that installation space can be saved overall.

According to a further preferred embodiment of the invention, the optical display device is at least one ring. In addition to a good visual appearance and better perceptibility by a user of the sanitary fitting, this also improves operability.

Further important features and advantages of the invention are described in more detail in the dependent claims, in the drawings, and in the accompanying figure description based on the drawings.

It should be understood that the features mentioned above and those to be explained below can be used not only in the combination indicated in each case, but also in other combinations or on their own, without departing from the scope of this invention.

BRIEF DESCRIPTION OF THE DRAWINGS

Preferred embodiments and embodiments of the invention are shown in the drawings and will be explained in more detail in the following description, wherein identical reference numerals refer to identical or similar or functionally identical components or elements.

DETAILED DESCRIPTION OF THE INVENTION

Figure 1:
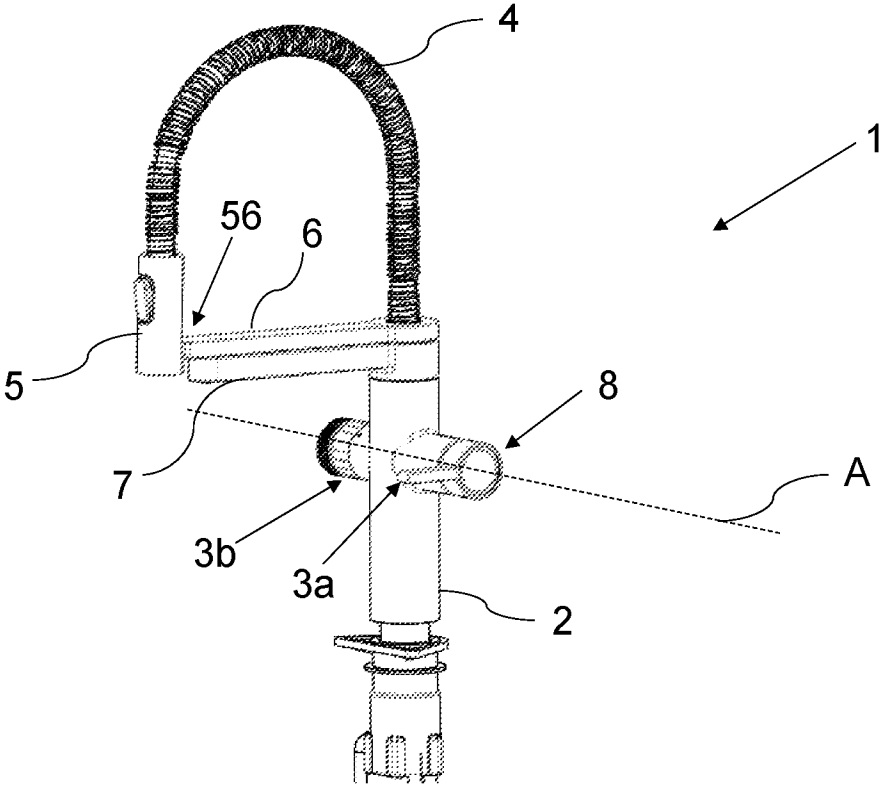
FIG. 1 shows a 3-dimensional view of a sanitary fitting according to an embodiment of this invention.

FIG. 1 shows a 3-dimensional view a sanitary faucet according to an embodiment of this invention.

In detail, FIG. 1 shows a sanitary fitting 1 for kitchens. The sanitary fitting 1 is part of a sanitary system 200 of FIG. 3. The sanitary fitting 1 comprises a cylindrical fitting body 2, at which one control-element unit 3*a*, 3*b* each is arranged perpendicular to the cylinder axis, i.e., along the axis A, on different sides of the fitting body 2. Here, the first control-element unit 3*a* is used to adjust a mixed-water temperature and a flow rate of a mixed water based on untreated hot and cold water. For this purpose, the first control-element unit 3*a* comprises a single-lever mixing device 8. The second control-element unit 3*b*, which is described in more detail in FIG. 2 below, a quantity and a treatment type for treated water can be set and a dispensing of the treated quantity of water can be triggered.

A water outlet 5, to which mixed water can be applied, is further arranged on the fitting body 2 in a swiveling manner via an outlet arm 4. Furthermore, the water outlet 5 is connected to a retaining arm 6 via a detachable connection 56, wherein the retaining arm 6 in turn is arranged on the fitting body 2 to be swiveled in parallel to the cylinder axis of the fitting body 2. The detachable connection 56 can be established, for instance, by a magnetic force. A further water outlet 7 is arranged on the underside of the holding arm 6, which can be used to dispense treated water, which can be adjusted by means of the second control-element unit 3*b*.

Figure 2:
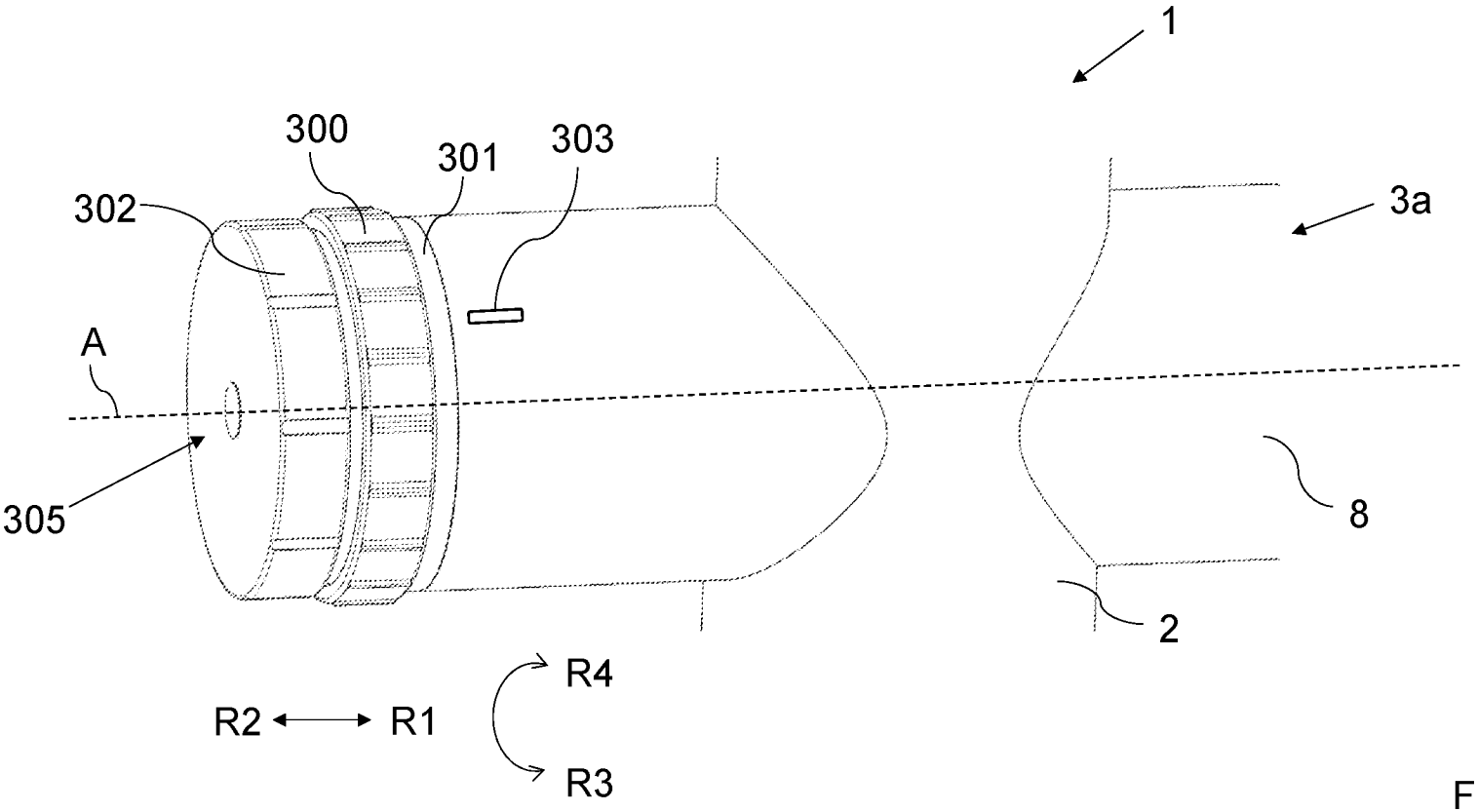
FIG. 2 shows a section of the sanitary fitting according to FIG. 1.
Figure 3:
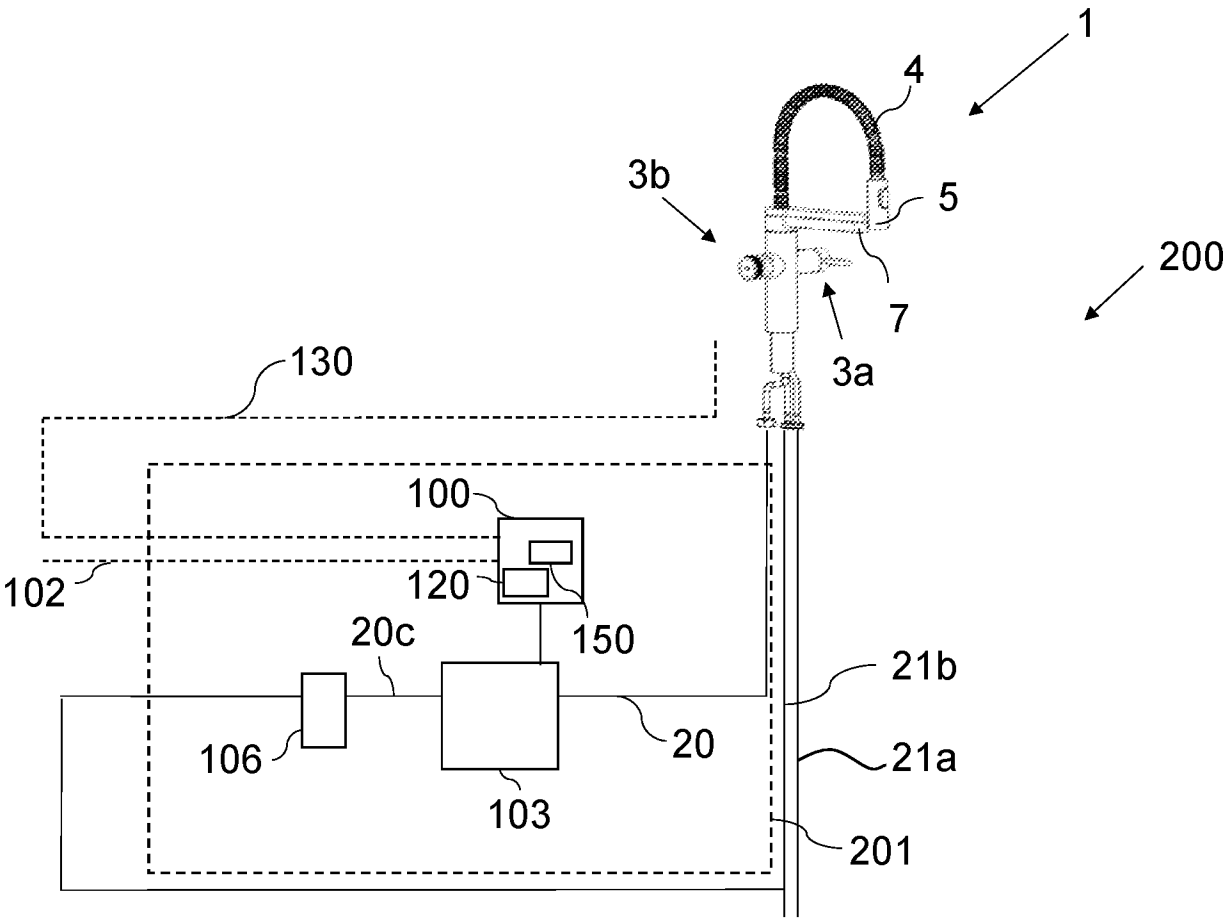
FIG. 3 shows a sanitary system according to an embodiment of this invention including a sanitary fitting according to FIG. 2.

FIG. 2 shows a three-dimensional section of the sanitary fitting according to FIG. 1 and FIG. 3 shows a sanitary system according to one embodiment of this invention having a sanitary fitting according to FIG. 2.

FIG. 2 shows essentially the second control-element unit 3*b* in detail. The second control-element unit 3*b* comprises a first control element 300 in the form of a ring rotatable about an axis A, which is arranged perpendicular to the axis of the cylindrical valve body 2. The first control element 300 is used to adjust the desired amount of treated water. For this purpose, the first control element 300 can have visually and haptically perceptible elevations in the form of radial projections for defining different setting positions.

There is an indicator 301 along axis A in FIG. 2 to the right of the first control element 300 and, again to the right, a highlight 303 indicating the position of the first control element 300. On the other hand, the highlight 303 may also be configured as a second indicator device adjacent to a first indicator device 301. The first indicator 301 is arranged on the right side of the first control element 300 and on the left side of the highlight 303, and is annular in shape. In this context, the first display device 301 comprises a total of 18 separately actuatable optical elements in the form of multicolored LEDs. The first display device 301 can be used to display different color representations on the one hand, for instance at least the colors red, white, green, yellow and/or orange or the like, and on the other hand also different colors simultaneously, for instance the colors red and white alternately in the circumferential direction. The second display device 303 can also be used to display various luminous colors, in particular the colors red and blue. Each of the two display devices 301, 303 can also display the color intermittently, in other words provide flashing in the respective color. The first display device 301 can thus also display temporal sequences, for instance in this way a display of a red dot. band, section or the like moving in the circumferential direction. The indicating devices 301, 303 may alternatively or additionally provide audible signals, such as an intermittent beeping or the like.

Furthermore, the second control-element unit 3*b* has a second control element 302, which is also annular in shape and is arranged to the left of the first control element 300. Like the first control element 300, the second control element 302 has a corrugation on its outer circumference to provide a user with a better grip. On the one hand, the second control element 302 is designed to be rotatable with directions of rotation R3, R4 about the axis A, and on the other hand, this control element is also arranged to be movable along the axis A in the axial direction R1, R2. On the surface of the second control element 302 there is a circular surface (not shown) with an actuating element 305 perpendicular to the axis A. The actuating element 305 is used to trigger the dispensing of treated water. The actuating element 305 can be designed to be actuated without contact or by means of contact. In this regard, the actuating element 305 may be in the form of an infrared sensor such that when the surface is touched, the actuating element 305 is triggered.

The second control element 302 can be moved to different snap positions by rotating it in the direction R4. Rotation in the opposite direction R3 may be permitted, but may not be permitted; then a user would only be able to continue rotating the second control element 302 in the direction R4. The second control element 302 is used to select the desired type of treated water. For this purpose, the second control element 302 can have visually and haptically perceptible elevations in the form of radial projections for defining different setting positions.

The operation of the sanitary fitting 1 will now be explained in detail. For this purpose, the sanitary fitting 1 is initially in idle/standby mode. This may be such that when the actuating element 305 is actuated in the standby mode, mixed water, in this case unfiltered tap water, is dispensed through the water outlet 5. No additional actuation of the second control element 302 is required.

While the mixed water is being dispensed, a running indication is given by means of nine LEDs—i.e., half a ring-towards the front (clockwise when looking at the surface along axis A). To this end, nine LEDs always light up simultaneously, the respective last LED is not actuated, the next LED is actuated. The speed of the sequence is chosen such that the half ring takes 2 seconds to circulate once completely.

If the actuating element 305 is actuated again during the dispensing of the mixed water, the dispensing of mixed water is aborted. If the actuating element 305 is not actuated again during the mixed water dispensing, the mixed water is output for 20 seconds and is then stopped. The value of 20 seconds can be set or changed via a corresponding App, for instance.

If the second control element 302 is actuated while the mixed water is being dispensed, no action is taken. If the first control element 300 is actuated during dispensing of mixed water, dispensing of water continues and/or stops after dispensing the set amount. After dispensing, the sanitary fitting 1 changes to the standby mode or, if necessary, to the corresponding mode specified by the second control element 302.

If the first control element 300 is set to a predefined quantity, in this case "0", i.e., to a certain predefined or predefinable quantity associated with a shutdown of the sanitary fitting 1, the sanitary fitting 1 is turned off. The indicator 301 is disabled and the first control element 300 and second control element 302 are disabled, so that none of the water types and no mixed water is dispensed when the latter is actuated. Likewise, no errors or a cleaning program that may already be running are indicated by means of the display device. If the cleaning program was started prior to shutdown, it continues until its regular termination; however, no indication is given by means of the display device 301. The mixing device 8 on the right side of the sanitary fitting 1 can still be used to independently tap mixed water.

FIG. 3 shows a sanitary system 200 comprising a sanitary fitting 1 according to FIGS. 1 and 2 and a treatment device 201 and a control device 100 in detail. Specifically, a filter device 106 is arranged, which is connected to a cold-water line 21*b* for supplying cold water. The filter device 106 can then be used to provide filtered water via a line 20*c* connected to a processing device 103 and via a line 20 connected to the water outlet 7. For this purpose, for controlling the processing device 103 the control device 100 is connected to the processing device 103 by wire or wirelessly. However, the processing device 103 may also be integrated into the control device 100.

The processing device 103 may comprise, for instance:

- the aforementioned filter device 106,
- a carbonation device for providing a carbonated fluid, in particular carbonated water,
- a warming and/or heating device for providing fluids at high temperature, in particular hot water,
- a cooling device, in particular for providing a cooled fluid, in particular water,
- an ionization device for ionizing a fluid, in particular water,
- an enrichment device for enriching the fluid by adding at least one substance, in particular mineral substance, flavoring, coloring or the like,
- an add-on device for adding concentrates, in particular fruit juice concentrates or the like, to a fluid,
- a hygienic device for providing hygienically treated fluid, in particular for sterilizing a fluid, and/or a cleaning device for providing a cleaning and/or rinsing medium instead of or to be added to a fluid.

The control device 100 has an electronic control device and is connected to the two control elements 300, 302, the display device 301, and to the actuating element 305 for the corresponding control or actuation thereof via a signal line 130. The control device 100 is further connected to a power supply 102 for its operation. Treated liquid, for instance filtered water, or if a hot-water system is provided, hot water, can be dispensed via the line 20 through the water outlet 7. The hot-water line 21*a* and the cold-water line 21*b* are connected to a mixer cartridge and further to the first water outlet 5 via the first control-element unit 3*a*, and mixed water having a corresponding temperature can be dispensed therethrough accordingly.

If the first control element 300 is set to "0", the components of the treatment device 201 continue to operate, for instance the heating device.

The water types and quantities are assigned directly at the control device 100, which may have a screen for this purpose, or by means of an App. To this end, the control device 100 has a display 120 and/or an interface 150 for configuring the individual control positions of the second control element 302 and the individual positions of the first control element 300 or is connected to such a display and interface. The interface 150, which is wireless, can be used to perform the configuration, for instance via an App of a smartphone, for instance by means of WLAN or Bluetooth. The configuration can also be cloud-based. Based on a profile stored on the Internet, a user can configure corresponding positions, which are then transmitted to the control device 100 by means of an Internet connection via the interface 150.

When the second control element 302 is actuated and then the actuating element 305 is actuated, the set type and amount of water is dispensed. While the water is being dispensed, a running indication is given by means of nine LEDs—i.e., half a ring—towards the front (clockwise when looking at the surface along axis A). To this end, nine LEDs always light up simultaneously, the respective last LED is not actuated, the next LED is actuated. The speed of the sequence is chosen such that the half ring takes 2 seconds to circulate once completely.

If the selection "boiling water" is stored at one of the specified positions, one of the display elements of the display device 301 lights up red. However, a safety device must first be overcome here by pressing and rotating the second control element 302 by a predetermined angle before the hot water can be tapped through the confirmation element 305. If the actuating element 305 is actuated again during the dispensing of the hot water, the hot water dispensing is stopped. If the second control element 302 is actuated during the dispensing of hot water, the hot water is dispensed in the selected amount. If the first control element 300 is actuated during the dispensing of hot water, dispensing is terminated after the selected quantity has been dispensed. After dispensing, the sanitary fitting 1 changes to the standby mode, however, or, if necessary, to the corresponding mode specified by the second control element 302.

In order to dispense or tap hot water, a safety barrier must be overcome, as explained above. To select boiling hot water, hot water, the second control element 302 has to be pushed in the direction of the first control element 301 along the axis A and rotated backwards by at least 80°. A haptic feedback, in particular by means of a grid, reports the correct, i.e., sufficient, angle of rotation back to a user. This hot water mode is indicated by the red color of all display elements of the display device 301.

After the hot water mode has been activated, the entire display device 301 is turned off after one second and only a red illuminated display element can be seen at the position of the highlight 303. The first control element 300 can then optionally be used to change the selected quantity by rotating it.

Touching the actuating element 305, particularly in the form of an infrared sensor, generally triggers the dispensing of any kind of water. Renewed pressing stops the dispensing of water, even if the set quantity has not yet been reached. While the water is being dispensed, a running indication is given by means of nine LEDs—i.e., half a ring-towards the front (clockwise when looking at the surface along axis A). To this end, nine LEDs always light up simultaneously, the respective last LED is not actuated, the next LED is actuated. The speed of the sequence is chosen such that the half ring takes 2 seconds to circulate once completely.

To indicate the status of the filter device 106, in standby mode, when the filter device 106 of the sanitary system 200 has a remaining filter time below a presettable threshold, a yellow indicator element comes on below the white indicator element.

The yellow display element is turned off only
- when the water type is selected, when the entire display device lights up,
- when an error is active and the entire display device pulses red,
- when the fitting is switched off, or
- when the cleaning program is running.

In standby mode of the sanitary fitting 1, if the residual filter time is below a predefinable threshold value and if the $CO_2$ pressure sensor detects less than a predefinable pressure value, for instance below 3 bar, a red indicator element comes on below the white indicator element.

The red display element is only turned off
- when the water type is selected, when the entire display device lights up,
- when an error is active and the entire display device pulses red,
- when the fitting is switched off, or
- when the cleaning program is running.

If a cleaning program has been started via the display 120 of the control device 100 or via the App, nine yellow display elements show a running indication, here in the form of LEDs—i.e., half a ring—towards the front (clockwise when viewed from the direction of the surface along axis A). To this end, nine LEDs always light up simultaneously, the respective last LED is not actuated, the next LED is actuated. The speed of the sequence is chosen such that the half ring takes 2 seconds to circulate once completely.

If the user has to be active during the cleaning program, such as replacing a cleaning cartridge, removing a cleaning cartridge, or the like, all of the display elements of the display device pulse yellow and the action to be taken is visualized on the display 120 of the control device 100 or using the App. If the cleaning program continues to run, a running indication is given by means of nine yellow illuminated display elements, as described above. At the end of the cleaning program, the sanitary system 200 returns to standby mode.

If an error has occurred in the sanitary system 200 or if a control menu is activated on the display 120 of the control device 100, the entire LED ring will pulse red; the sanitary system 200 is now in error mode. In that case, no setting can be made via the two control elements 300, 302, and the control element 305 is switched off. Error mode is an interrupt to any other state and interrupts all operations; an active dispensing of water is canceled in the event of an error or of the activation of the menu on the display. An active error during the cleaning program temporarily disables the sanitary system.

When the second control element 302 is actuated in standby, all of the display elements of the display device 301 display the appropriate color according to the desired type of treatment, and the type of treated water can be selected. When the second control element 302 is rotated forward (clockwise as viewed from the actuating element), the water type changes the color of the indicator 301 from green, light blue to blue at each notch. There, green denotes still water, light blue medium sparkling and blue classic sparkling. When turning in the other direction, the order is reversed. After the actuating element 305 has been actuated, the complete display device 301 lights up for 1 second in the selected color. After this second, only one LED is displayed at highlight 303 in the selected color.

To select the "Classic sparkling" water type and dispense the same, proceed as follows:

After the water type "Classic sparkling" has been selected by means of the second control element 302, the entire LED illuminated ring is turned off and only one display element in the color of the desired water type lights up at the point—in this case blue—where the selected quantity is set. The first control element 300 can then be used to optionally change the selected quantity by rotation. For instance, thirteen fixed or preset volume settings are available here (from 100 to 1000 ml). In addition, a further four freely configurable water quantities can also be provided.

Touching the actuating element 305 triggers the dispensing of water. As long as the desired water is dispensed, nine LEDs—i.e., half a ring—give a running indication as described above. To this end, nine LEDs always light up simultaneously, the respective last LED is not actuated, the next LED is actuated. The speed of the sequence is chosen such that the half ring takes 2 seconds to circulate once completely.

After tapping the desired water, the sanitary fitting 1 remains in the selected setting for 5 seconds and an indicator element of the display device 301 lights up in the corresponding color. It can now be tapped again or the settings can be changed, for instance, the quantity can be changed. After the specified time period has elapsed, in this case 5 seconds, the sanitary fitting 1 returns to standby mode. In standby mode, the one display element of the display device 301 lights up white again.

In summary, at least one of the embodiments of the invention has at least one of the advantages listed below:

superior user experience.

high flexibility regarding the individual configuration of the sanitary fitting.

easy to manufacture and implement.

reliable selection of treated water and error indication.

Although this invention has been described with reference to preferred exemplary embodiments, it is not limited thereto and can be modified in a variety of ways.

LIST OF REFERENCE NUMERALS

1 sanitary fitting
2 fitting body
3*a* first control-element unit
3*b* second control-element unit
4 outlet arm
5 water outlet
6 retaining arm
7 water outlet
8 mixing device
20 line
20*a* line
20*b* line
20*c* line
21*a* hot-water line
21*b* cold-water line
56 detachable connection
100 control device
102 power supply
103 processing device
106 filter device
120 display
130 signal line
150 interface
200 sanitary system
201 treatment device
300 first control element
301 first display device
302 second control element
303 highlight/second display device
305 actuating element
A axis
R1, R2 axial direction
R3, R4 direction of rotation

The invention claimed is:

1. A sanitary system comprising:

a sanitary faucet; and a control device, wherein:

the sanitary faucet includes: (i) a first control element for setting at least one of a plurality of quantities of a liquid to be dispensed; and (ii) a second control element for setting at least one of a plurality of types of the liquid to be dispensed;

at least one of the first control element or the second control element has a plurality of defined control positions;

the control device is connected to the first control element and the second control element; and the control device is programmed to assign at least one of the plurality of defined control positions so as to preconfigure or reconfigure: (i) the at least one of the plurality of quantities of the liquid to be dispensed; or (ii) the at least one of the plurality of types of the liquid to be dispensed.

2. The sanitary system of claim 1, wherein at least one of the first control element, the second control element or the control device includes an interface for configuring the at least one of the plurality of defined control positions.

3. The sanitary system of claim 2, wherein the interface is wired.

4. The sanitary system of claim 2, wherein the interface is wireless.

5. The sanitary system of claim 1, further comprising a display device for visual or audible display of a configuration of the at least one of the plurality of defined control positions.

6. The sanitary system of claim 5, wherein the display device is configured to display an optical sequence as a flashing or intermittent display of colors for configuring the control device and the at least one of the plurality of defined control positions.

7. The sanitary system of claim 5, wherein the display device is integrated into at least one of the first control element or the second control element.

8. The sanitary system of claim 5, wherein the display device includes at least one ring.

9. The sanitary system of claim 1, wherein the control device is configured to store different configurations for different users of the sanitary faucet.

10. The sanitary system of claim 9, wherein the control device includes an interface for selection of a configuration of the at least one of the plurality of defined control positions by one of the different users of the sanitary faucet.

11. The sanitary system of claim 1, wherein:

the control device includes an interface configured to connect to the Internet; and a configuration of the at least one of the plurality of defined control positions is cloud-based.

12. The sanitary system of claim 1, further comprising a treatment device for treating the liquid to be dispensed, wherein the treatment device is connected to the sanitary faucet.

13. The sanitary system of claim 12, wherein the treatment device comprises:

a filter device;

a carbonation device;

a heating device;

a cooling device;

an ionization device;

an enrichment device;

a concentrate adding device;

a hygienic device; or a cleaning device.

14. The sanitary system of claim 12, wherein the treatment device comprises:

a filter device;

a carbonation device;

a heating device;

a cooling device;

an ionization device;

an enrichment device;

a concentrate adding device;

a hygienic device; and a cleaning device.

15. The sanitary system of claim 1, wherein:

each of the first control element and the second control element has the plurality of defined control positions; and the control device is programmed to assign: (i) all of the plurality of defined control positions of the first control element so as to reconfigure all of the plurality of quantities of the liquid to be dispensed; and (ii) all of the plurality of defined control positions of the second control element so as to reconfigure all of the plurality of types of the liquid to be dispensed.

* * * * *